United States Patent [19]

Nakanishi

[11] Patent Number: 4,714,942

[45] Date of Patent: Dec. 22, 1987

[54] REVERSAL IMAGE DEVELOPMENT TYPE ELECTROPHOTOGRAPHIC PRINTING SYSTEM

[75] Inventor: Akio Nakanishi, Funabashi, Japan

[73] Assignee: Fujitsu Limited, Kawasaki, Japan

[21] Appl. No.: 875,669

[22] Filed: Jun. 18, 1986

[30] Foreign Application Priority Data

Jun. 18, 1985 [JP] Japan ..... 60-132530

[51] Int. Cl.[4] ..... G03G 15/00; G03G 15/08

[52] U.S. Cl. ..... 355/14 R; 355/3 R; 355/3 DD; 355/14 D; 355/14 CH; 430/122

[58] Field of Search ..... 355/3 R, 14 R, 300, 355/140, 3 CH, 14 CH; 430/122

[56] References Cited

U.S. PATENT DOCUMENTS 3,805,739 4/1974 Feldeisen et al. ..... 355/14 D X
4,072,415 2/1978 Inoue et al. ..... 355/14 R
4,337,306 6/1982 Kanbe et al. ..... 430/122

*Primary Examiner*—A. C. Prescott
*Attorney, Agent, or Firm*—Staas & Halsey

[57] ABSTRACT

A reversal image development type electrophotographic printing system including a rotatable drum (1) coated with a light sensitive layer and an image developing roller (31) co-rotatable with the drum and using a printing medium composed of carriers and toner. To prevent superfluous toner during start-up, a predetermined bias voltage (−VB) differing to a normal bias voltage (+VB) is supplied to the image developing roller and the drum, and the image developing roller, a precharger (2), and power supplies (52, 53) for supplying the initial and normal bias voltages are energized in a predetermined start sequence. In addition, to prevent carrier extraction at a stop condition, the drum, the image developing roller, the precharger, and the power supply (53) are deenergized in a predetermined operation stop sequence.

A printing medium including a resin toner comprising a mixed resin and magnetized powder and a charge control medium mixed with the resin toner may be used, and prevention of the surplus resin toner extraction in the start-up condition also may be achieved.

17 Claims, 14 Drawing Figures

100
200
CONTROLLER
START
STOP
101
102
103
104
111
112
113
τ11
τ12
τ13
τ14
τ21
τ22
τ23
TES11
TES12
TES13
TES14
TES21
TES22
TES23
121
122
123
124
54
SC4
SC1
SC2
SC3
29
51
52
53
54
DC SERVO
HV1
HV2
HV3
HV4
-VB
+VB
-HV
22
2
31
8
DCM
PRE CHARGE
IDR
XFER DEV

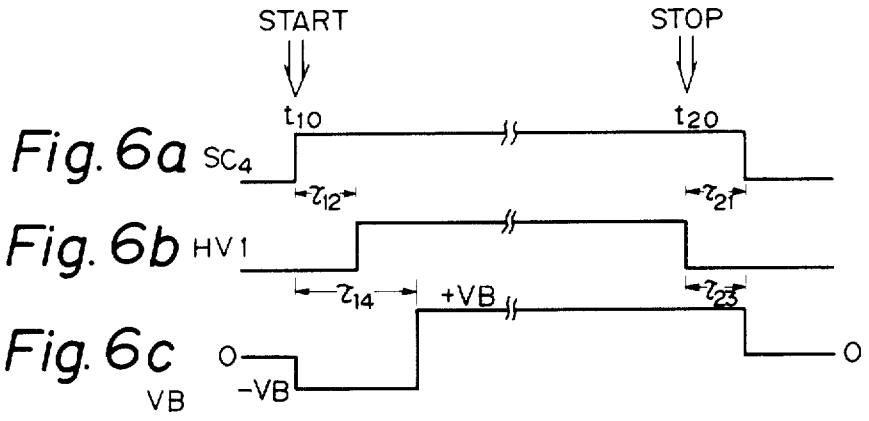
Fig. 7
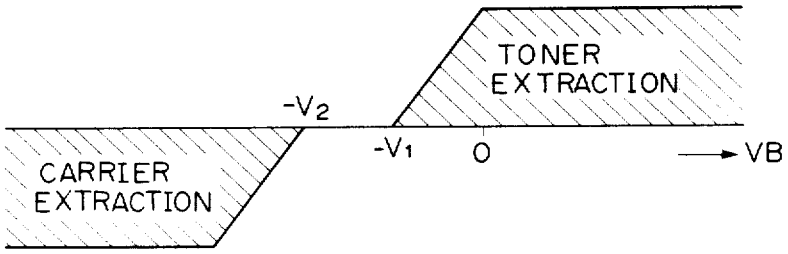

REVERSAL IMAGE DEVELOPMENT TYPE ELECTROPHOTOGRAPHIC PRINTING SYSTEM

BACKGROUND OF THE INVENTION

1. Field of the Invention

The present invention relates to an electrophotographic printing system. More particularly, it relates to a reversal image development type electrophotographic printing system in which a rotatable means coated with a light sensitive layer and an image developing roller are used in cooperation.

2. Description of the Related Art

Electrophotographic printing (recording) systems are extensively known, and are categorized into two types on the basis of a latent image formation; a positive image development type electrophotographic printing system and a reversal image development type electrophotographic printing system. In the former system, non-image formation areas on the light sensitive layer on a drum charged with approximately several hundreds volts are light-scanned to reduce the voltage there at and toner having an opposite polarity to the light sensitive layer is deposited on other portions on the light sensitive layer retaining a high charge. Conversely, in the latter system, image formation areas on the light sensitive layer are light-scanned to reduce the voltage there at. Toner, having a same polarity as the image formation areas and carrying a charge generated by friction between the carriers and the toner, is deposited on the image formation areas. The present invention essentially pertains to the latter system, i.e., the reversal image development type electrophotographic printing system using a printing medium normally having two components, i.e., carriers and toner.

Due to the principle of reversal image development, in a start-up condition of the reversal image development type electrophotographic printing system, superfluous toner is deposited on the light sensitive layer. Similarly, in a stop condition, the carriers are extracted from the light sensitive layer. These phenomena will be described later in detail with reference to specific embodiments. The above extra toner and carriers are wasted and may shorten a life of a cleaner.

When a mono-component developing medium having resin toner comprising a mixed magnetized powder and resin, and a charge control medium is used, superfluous developing medium extraction also may occur in a start-up condition.

To overcome the above defects, separate drives for the rotatable drum covered with the light sensitive layer and the image developing roller facing the drum and bearing the printing medium thereon, have been disclosed. However, this approach suffers from a disadvantage in that two independent motors must be provided for separately driving the drum and the roller. Thus, a complex control circuit must be provided. Accordingly, this approach greatly increases the cost of the system.

SUMMARY OF THE INVENTION

An object of the present invention is to provide a reversal image development type electrophotographic printing system having a simple construction and preventing the presence of superfluous printing media in start-up and stop conditions, with a low cost.

Another object of the present invention is to provide a reversal image development type electrophotographic printing system in which a life of a cleaner therein is lengthened, and accordingly, the printing quality is improved.

According to the present invention, there is provided an electrophotographic printing system including a rotatable device having a light sensitive layer thereon, a precharging unit having a precharger provided adjacent to the outer surface of the rotatable device and a first power supply supplying a high voltage to the precharger and charging the light sensitive layer at a predetermined voltage. A unit is provided unit for exposing light beams onto the charged light sensitive layer so as to form latent images on the charged light sensitive layer and a unit is provided for developing images at portions of the light sensitive layer on which the latent images are formed, including an image developing roller unit. The image developing roller unit is rotatable along with the rotatable device and contains magnets and a sleeve covering thereon. A second power supply supplies a first bias voltage of a predetermined value to the magnetized roller to prevent a deposition of printing medium onto the light sensitive layer during at least start-up. A third power supply supplies a second bias voltage of a predetermined value to the magnetized roller to carry out image developing during a normal condition. The printing system also includes a unit for discharging charges on the light sensitive layer and a unit for controlling at least the start of the rotatable device and the image developing roller unit, and the energization and deenergization of the first, second, and third power supplies in a predetermined sequence defined by positions of the precharging unit, the image developing roller and the discharging unit and a rotational speed of the rotatable device, in at least the start-up condition.

The control unit may control the rotatable device, the image developing roller rotatable along with the rotatable device, and the first to third power supplies in the following sequence during the start-up condition. First, starting the rotation of the rotatable device and energizing the second power supply. Second, energizing the first power supply after the lapse of a first time. Third, energizing the third power supply and deenergizing the second power supply after the lapse of a second time taken by the portion of the light sensitive layer facing the discharging unit at the initial condition to reach the image developing unit after the starting rotation of the rotatable device. The control unit may include timers for counting the above times. Preferably, the first time may be a time taken by a portion of the light sensitive layer facing the discharging unit at an initial condition to reach the precharging unit after the energizing. The first time also may be zero.

The printing medium may include carriers and toner. The toner is electrostatically charged by friction electricity caused by agitating the carriers and the toner and having a same polarity as a charge on the light sensitive layer. The control unit may further control, in the stop condition, the rotatable device. The image developing roller is rotatable along with the rotatable device and the first and third power supplies, in the following sequence: deenergizing the first power supply, stopping the rotation of the rotatable device and deenergizing the third power supply after the lapsed of a third time in which a portion of the light sensitive layer facing the discharging unit at the beginning of the stop time reaches the image developing roller. The control unit may also include a timer for counting the above third time.

The printing medium may include a resin toner comprising a mixed resin and magnetized powder and a charge control medium mixed with the resin toner. The resin toner is electrostatically charged by the sleeve on the developing roller.

Preferably, the high voltage of the first power supply is approximately 5 KV to 6 KV to supply charges of approximately 500 V to 600 V to the light sensitive layer which may be reduced to approximately 0 V to 100 V by exposing light beams thereon. The first bias voltage of the second power supply is between −50 V to −100 V and the second bias voltage of the third power supply is approximately 300 V.

The electrophotographic printing system may further include a cleaner in contact with the light sensitive layer, an image transfer device transferring the toner deposited on the light sensitive layer to a paper, a paper separator separating the paper attached to the light sensitive layer, and an image fixing device fixing the toner on the paper.

BRIEF DESCRIPTION OF THE DRAWINGS

Other objects and features of the present invention will be described below in detail with reference to the accompanying drawings, in which:

FIGS. 6*a* to 6*c* are timing charts of the circuit shown in FIG. 5;

FIG. 7 is a graph of a bias voltage on a developing roller in the printing system in FIG. 1;

DESCRIPTION OF THE PREFERRED EMBODIMENT

Figure 1:
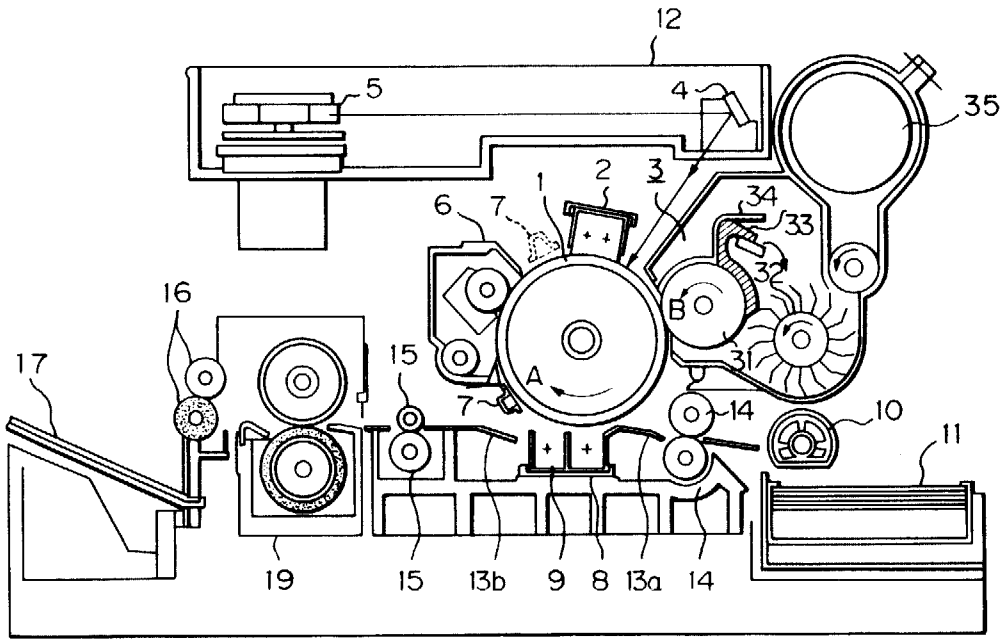
FIG. 1 is a sectional view of a reversal image development type electrophotographic printing system to which embodiments of the present invention may be applied.

Referring to FIG. 1, a reversal image development type electrophotographic printing system includes a light sensitive drum 1 coated with a light sensitive layer of light semiconductors, such as an organic photo-conductor (OPC) or amorphous silicon, a precharger 2 supplying charges to the light sensitive layer, an image developing device 3, a discharging (charge-removing) device 7, a cleaner 6, and an optical unit 12 containing a reflecting mirror 4, a rotatable multifaced mirror 5, and a laser light source (not shown). The printing system also includes a pick-up roller 10 for picking up feed papers 11, waiting rollers 14, front and back guides 13*a* and 13*b*, an image transfer device 8, an AC paper separation charger (or paper separator) 9, delivery rollers 15, a thermal roller-type image fixing device 19, delivery rollers 16, and a stacker 17. The image developing device 3 includes a developing roller 31 consisting of magnets and a sleeve covering thereon, an agitation roller (or paddle roller) 32, a blade 34, a toner hopper 35, and a printing medium having two components, i.e., carriers containing ferrite, iron, etc., and a toner containing carbon etc. The toner fed from the toner hopper 35, and the carriers, are forcibly agitated by the paddle roller 32, and consequently the toner is charged with frictional electricity, and the charged toner is deposited on an outer circumferential surface of each carrier having a larger diameter, e.g., approximately 100 μm, than that of the toner. The charged and combined printing medium 33 is deposited on the surface of the sleeve of the image developing roller 31. The surplus printing medium 33 is detached by the blade 34 in response to rotation of the sleeve of the image developing roller 31 in a direction B in FIG. 1. In this embodiment, the magnets are not rotated. The necessary printing medium 33 remaining on the surface of the sleeve of the image developing roller 31 is used for printing by contact with the light sensitive layer on the drum 1.

The operation of the printing system will be briefly described.

The drum 1 is rotatable in a direction A in FIG. 1. Charges in the light sensitive layer on the drum 1 are discharged by the discharging device 7. The toner on the discharged light sensitive layer is removed at the cleaner 6. The light sensitive layer on the drum 1 is charged to approximately 500 to 600 volts by the precharger 2, comprising a tungsten wire of approximately 60 to 80 μm and supplied with approximately 5 to 6 KV, on the basis of the principle of corona electrical discharge. Due to the above charge, the light sensitive layer exhibits a high resistance. The laser (not shown) emits beams modulated in response to data to be printed to the rotating multifaced mirror 5. The beams incident on each face of the mirror 5 are horizontally reflected onto the mirror 4. The beams reflected from the mirror 4 are reflected onto the charged and rotating light sensitive layer in an axial direction of the drum 1. Portions of the light sensitive layer irradiated by the beams are brought to a low resistance and low voltage state, for example, approximately 0 to 100 volts. The toner on the image developing roller 31 is deposited on the voltage-reduced portions of the light sensitive layer. This is a principle of an electrostatic latent image formation of a reversal image.

The paper 11 is delivered above the image transfer device 8 through the pick-up rollers 10, the waiting rollers 14, and the guide 13*a*, and is attached to the drum 1. The charged toner on the light sensitive layer on the drum 1 is transferred onto the paper 11 by adding an opposite polarity voltage from the image transfer device 8. The paper 11 having the toner thereon is detached from the light sensitive layer on the drum 1 by the application of an AC voltage by the paper separator, and is delivered to the thermal roller type image fixing device 19. The toner on the paper is image-fixed at the image fixing device 19. The thermal-image-fixed paper 11 is then delivered to the stacker 17 through the delivery roller 16.

After the paper is detached from the drum 1, images on the light sensitive layer on the drum 1 are electrically erased by the discharging device 7. Any toner remaining on the layer is removed by the cleaner 6.

Figure 2:
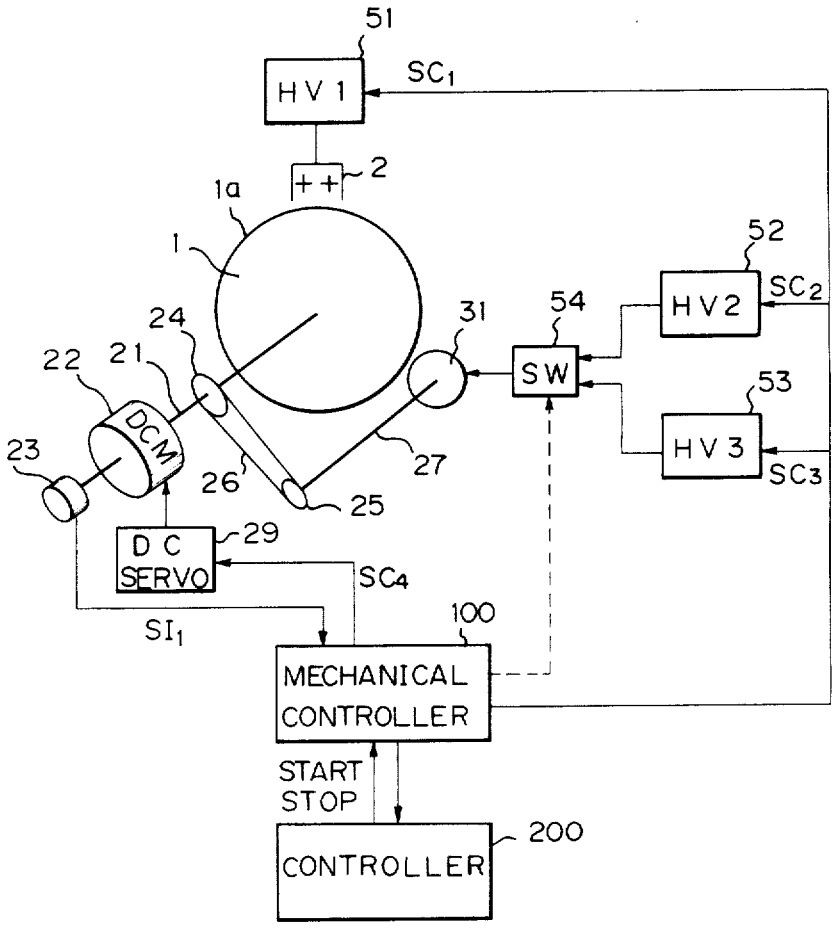
FIG. 2 is a block diagram of an embodiment of the present invention which is applied to the electrophotographic printing system shown in FIG. 1.

Referring to FIG. 2, the rotatable drum 1 is driven by a DC motor 22 through a shaft 21. A pulley 24 is provided on the shaft 21 and is mechanically connected to a pulley 25 fixed on a shaft 27, which is mechanically connected to the image developing roller 31 at another end thereof, through a belt 26. Accordingly, the drum 1 and the roller 31 are both operated by the motor 22. Precisely speaking, the sleeve covering the magnets of the roller 31 is rotatable and the magnets are not rotatable in this embodiment, as set forth above. This results, on the one hand, in a simple construction and low cost, compared to an independent drive system controlling the drum 1 and the roller 31 independently, but on the other hand, the problems of superfluous toner and carrier consumption occur, which will be described later.

Figure 3:
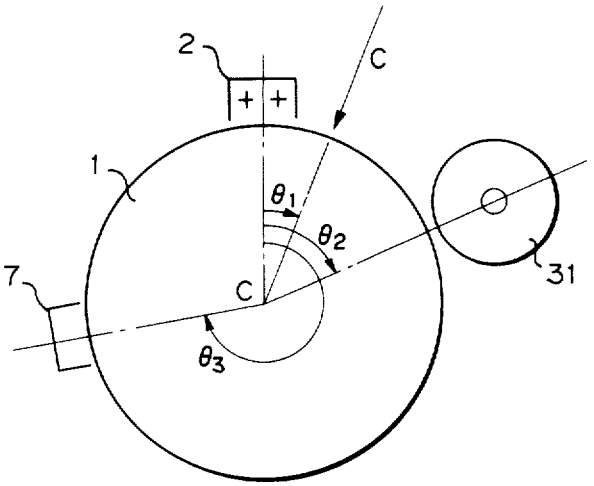
FIG. 3 is a partial sectional view of the electrophotographic printing system shown in FIG. 1.

Referring to FIG. 3, a specific arrangement of the precharger 2, the image developing roller 31, the discharging device 7, and an emitting direction C of the beam in FIG. 1 will be described. In this embodiment, an angle $\theta_1$ from a center of the precharger 2 to the emitting direction is 22 degrees, an angle $\eta_2$ from the center of the precharger 2 to a center of the roller 31 is 66 degrees; and an angle $\theta_3$ from the center of the precharger 2 to a center of the discharging device 7 is 260 degrees.

Figure 4:
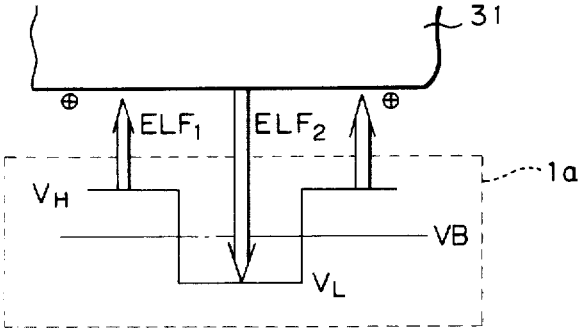
FIG. 4 is a schematic view of the reversal image printing of the electrophotographic printing system shown in FIG. 1.

Referring to FIG. 4, at the angle $\theta_2$ between the roller 31 and the drum 1, portions of the light sensitive layer 1*a* on the drum 1 exposed by the beam have a low voltage $V_L$ of approximately 0 to 100 volts, and other portions thereof have a high voltage $V_H$ of approximately 500 to 600 volts. The image developing roller 31 is supplied with a bias voltage $V_B$, which may be an intermediate voltage between $V_H$ and $V_L$, i.e., approximately 300 volts. As a result, electric lines of force $ELF_1$ and $ELF_2$ may appear as shown in FIG. 4. That is, the electric lines $ELF_1$ between the nonexposed portions having the high voltage $V_H$ and the image developing roller 31 having the bias voltage VB lower than $V_H$, flow directly from those portions to the roller 31. The electric lines $ELF_2$ between the exposed portions having the low voltage $V_L$ and the roller 31 having the bias voltage VB higher than $V_L$ flow directly from the roller 31 to those portions. As a result, the toner on the sleeve of the roller 31 and friction-charged with a same polarity as the polarity of the light sensitive layer is attracted to the low voltage portions and deposited thereon.

Referring to FIGS. 1 to 4, in a start up condition, the charge at the light sensitive layer is zero volt. Upon receipt of a start signal, the drum 1 and the roller 31 are simultaneously rotated. At the same time, the roller 31 is supplied with the bias voltage VB, and the precharger 2 is energized. The light sensitive layer forward of the precharger 2 in the rotational direction is not charged, and thus is zero volt. Accordingly, the portion of the light sensitive layer in the angle $\theta_2$ shown in FIG. 3 is covered with the toner from the roller 31, over a whole surface of the layer on the drum 1 along the axial direction thereof. The toner deposited on the light sensitive layer is not used for printing, and is removed by the cleaner 6. The amount of the toner removed by the cleaner 6 is much larger than that normally removed. This apparently causes a wasteful toner consumption and a shortening of the life of the cleaner 6.

If the printing system is restarted after a short stop time, such as one second, approximately 90% of the precharged voltage may remain. In this case, the above defect may not occur. But if the restart time becomes long, such as more than several seconds, the precharged voltage may be lost, and consequently, the above defect may occur.

On the contrary, in a stop condition of the printing system, when the bias voltage supplied to the roller 31 is removed at the same time as a stop signal is received, a carrier extraction problem may arise, because the charged voltage on the light sensitive layer still remains. Accordingly, the carriers extracted from the image developing roller 31 and deposited on the light sensitive layer are wasted, which also may lead to a shortening of the life of the cleaner 6.

FIG. 2 shows a mechanical controller 100 which will eliminate the above defects, and relevant components thereof are described below. The mechanical controller 100 receives a start signal and a stop signal from a controller 200. Upon receipt of the start signal or the stop signal, the mechanical controller 100 activates the DC motor 22 through a DC servo system 29 by supplying a control signal $SC_4$ thereto. This actuates the high voltage sources 51 to 53 by supplying control signals $SC_1$ to $SC_3$ thereto, and controls a switching circuit 54. The mechanical controller 100 also reads a position sensing signal $SI_1$ from a position sensor 23 fixed to the shaft 21. The position sensing signal $SI_1$ is used for controlling the motor 22 in a normal operation.

Figure 5:
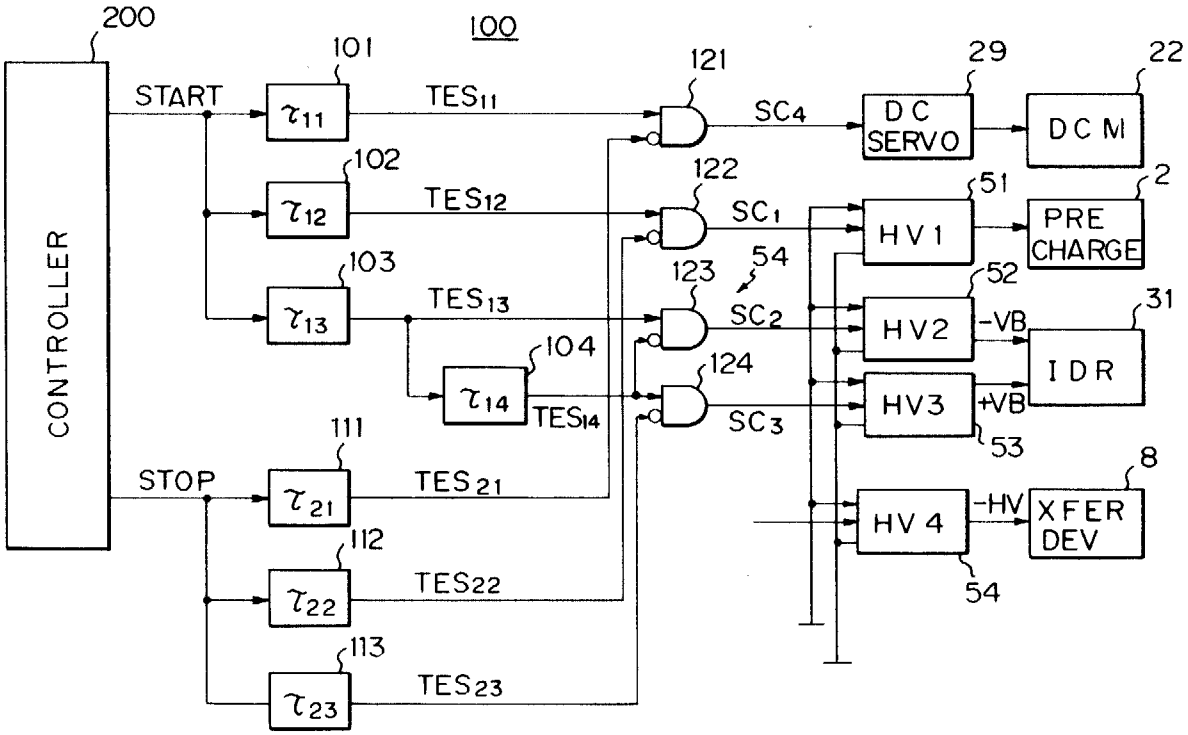
FIG. 5 is a control circuit diagram of the embodiment shown in FIG. 2.

Referring to FIG. 5, a control circuit of the mechanical controller 100 shown in FIG. 2 includes timers 101 to 104 and 111 to 113, and gates 121 to 124. The connection between the mechanical control circuit 100 and the controller 200 and between the mechanical control circuit 100 and the components 29 and 51 to 54 is also shown. The switching circuit 54 in FIG. 2 is realized by a switching circuit 54' consisting of the gates 123 and 124.

Referring to FIGS. 6*a* to 6*c* and 7, the operation of the circuit in FIG. 5 will be described.

In a start-up mode, when the mechanical controller 100 receives a "START" signal from the controller 200 at a time $t_{10}$, the timers 101 to 103 in the mechanical controller 100 will start time counts and output time-elapsed signals $TES_{11}$ to $TES_{13}$ to the gates 121 to 123. The signal $TES_{13}$ is also output to the timer 104. In this embodiment, time delays $\tau_{11}$ and $\tau_{13}$ are zero. A time delay $\tau_{12}$ is a time when a portion of the light sensitive layer on the drum 1 facing the discharging device 7 reaches the precharger 2 by rotating through an angle $(360° - \theta_3)$. A time delay $\tau_{14}$ is a summation of the time delay $\tau_{12}$ and a time $\tau_{15}$, and represents the time when a portion of the light sensitive layer under the precharger 2 reaches the image developing roller 31 by rotating through the angle $\theta_2$. The angles $\theta_1$, $\theta_2$ and $\theta_3$ are 22, 66, and 260 degrees, respectively, as mentioned above with reference to FIG. 3. In this embodiment, a diameter of the drum 1 is 80 mm, and a normal rotational circumferential speed of the drum 1 driven by the motor 22 is 120 mm/s. According to the above parameters, the theoretical values to $\tau_{12}$, $\tau_{15}$ and $\tau_{14}$ are as follows: $\tau_{12} = 80\pi \cdot (360 - \theta_3)/360/120 \approx 580$ ms and $\tau_{15} = 80\pi \cdot 66/360/120 \approx 384$ ms, and thus $\tau_{14} = \tau_{12} + \tau_{15} \approx 964$ ms. In practice, however, a spread of the precharger 2, a facing portion between the light sensitive layer on the drum 1 and the roller 31, and the discharging device 7, and also a time lag before the rated speed of the drum 1 is attained should be taken into account. An experimental value of $\tau_{12}$ is determined to be 560 ms to 620 ms and an experimental value of $\tau_{14}$ is determined to be 900 ms to 1,050 ms.

Upon receipt of the start signal, the timers 101 and 103 immediately output the signals $TES_{11}$ and $TES_{13}$ to the gates 121 and 123, which are supplied with high level signals through inverted input terminals thereof, from the timers 111 and 113, whereupon the servo system 29 and the high voltage source 52 are energized. Then, the motor 22 is driven, and accordingly, the drum 1 and the image developing roller 31 are both rotated. At the same time, the image developing roller 31 is supplied with a voltage −VB from the power source 52. The bias voltage −VB is determined from a characteristic shown in FIG. 7. When the voltage of the light sensitive layer on the drum 1 is approximately zero, extra toner extraction may occur if the bias voltage of the roller 31 is higher than a voltage $-V_1$, for example, −50 volts. On the other hand, carrier extraction may also occur if the bias voltage of the roller 31 is lower than a voltage $-V_2$, for example, −100 volts. To avoid the above adverse phenomena, the bias voltage −VB is set between $-V_1$ and $-V_2$, and in practice, is approximately −75 volts.

After the elapse of the time delay $\tau_{12}$, the timer 102 outputs the signal $TES_{12}$ to the gate 122, energizing the power supply 51, and accordingly, supplying a high voltage of 5 KV to 6 KV to the precharger 2. The light sensitive layer on the drum 1 is charged up to approximately 500 to 600 volts by the subsequent corona electric discharge, as set forth above. After the elapse of the time delay $\tau_{14}$, at the moment when the charged light sensitive layer on the drum 1 is just beginning to reach the image developing roller 31, the timer 104 outputs the signal $TES_{14}$ to the gates 123 and 124, de-energizing the power source 52 having the bias voltage −VB and, simultaneously, energizing the power source 53 having the bias voltage of +VB, which is an intermediate voltage between a $V_L$ of 0 to 100 volts and a $V_H$ of 500 to 600 volts shown in FIG. 4, e.g., 300 volts in this embodiment. As a result, the bias voltage VB supplied to the image developing roller 31 is changed from −VB for the start-up mode to +VB for the normal mode, and the normal printing operation is then started.

In the above operation, there is no superfluous toner consumption, and consequently, the cleaner 6 is not over-loaded. This can also increase the printing quality.

The stop operation also will be described with reference to FIGS. 5 to 7.

In the normal mode, one of the input terminals of the gate 121 to 124 are supplied with high level signals from the timers 101 to 104. Upon receipt of a "STOP" signal from the controller 200 at a time $t_{20}$, the timers 111 to 113 start a time count. A time delay $\tau_{22}$ in the timer 112 is zero, and thus the timer 112 immediately outputs the time elapsed high level signal $TES_{22}$ to the gate 112, to de-energize the power source 51. The precharger 2 is then prevented from charging the light sensitive layer. After the elapse of time delays $\tau_{21}$ and $\tau_{23}$ in the timers 111 and 113, the control signals $SC_4$ from the gate 121 and the control signals $SC_3$ from the gate 124 become low level, disenabling the motor 22 and the power source 53, and accordingly, the motor is stopped and thus the rotation of the drum 1 and the image developing roller 31 is stopped. The voltage of the image developing roller 31 then becomes approximately zero. The time delay $\tau_{23}$ is the time when a portion of the light sensitive layer on the drum 1 facing to the precharger 2 at the stop time reaches the image developing roller 31 after the precharging is completed. An ideal value of the time delay $\tau_{23}$ is approximately 384 ms, and a practical value of the time $\tau_{23}$ is 360 ms to 400 ms. The time delay $\tau_{21}$ is identical to the time delay $\tau_{23}$.

The above stop sequence of operation enables the carrier extraction in the stop mode to be avoided, and this prevents an over load at the cleaner 6.

Figure 8:
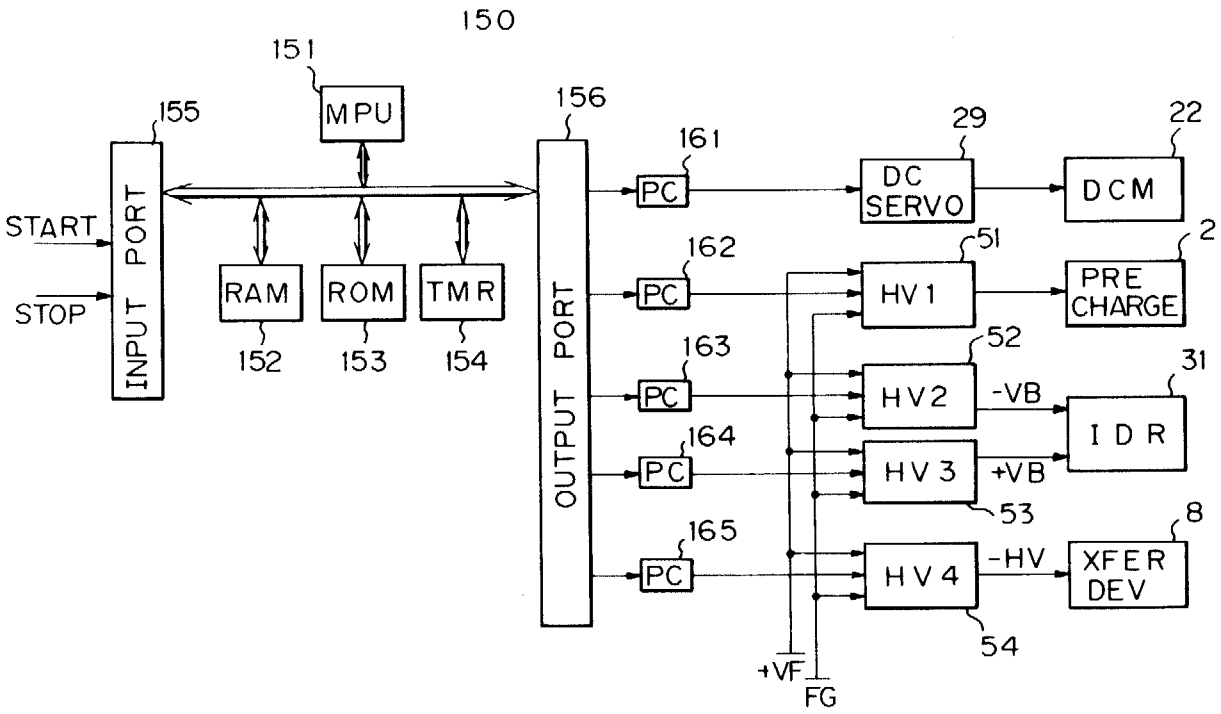
FIG. 8 is another control circuit diagram of the embodiment shown in FIG. 2.

The above operational sequence of the printing system in the start-up and stop condition may be realized by other circuit controllers. FIG. 8 is another example of the mechanical controller 100 in FIG. 2, in place of the controller shown in FIG. 5. The mechanical controller 150 in FIG. 8 includes an input port 155 receiving the start and stop signals from the controller 200, a microprocessor unit (MPU) 151, a random access memory (RAM) 152 storing control parameters, a read-only memory (ROM) 153 storing control programs, a timer unit (TMR) 154 counting the above time delays, and an output port 156. The mechanical controller 150 also includes photo couplers 161 to 165 electrically isolating a control signal from the output port 156 to the components 29 and 51 to 54.

FIG. 9 is a flow chart explaining the control function of the mechanical controller 150.

In the start-up mode, the mechanical controller 150 waits to receive a start signal from the controller 200 at steps S010 and S011. Upon receipt of the start signal, the mechanical controller 150 energizes the power source (HV2) 52 of the bias voltage −VB, de-energizes the power source (HV3) 53, and energizes the DC motor (DCM) 22, at steps S011 and S012. The mechanical controller 150 waits for the time delay $\tau_{12}$ shown in FIG. **6*b* at steps S013 and S014, and energizes the power source (HV1) 51 at step S015 after the elapse of the time delay $\tau_{12}$. The mechanical controller 150 also waits for the time $\tau_{14}$ shown in FIG. 6C at steps S016 and S017, de-energizes the power source (HV2) 52, and energizes the power source (HV3) 53 of the bias voltage +VB after the elapse of the time delay $\tau_{14}$. The normal operation control (S020**) is then carried out.

In the stop mode, the mechanical controller 150 waits to receive a stop signal from the controller 200 at steps S050 and S051. Upon receipt of the stop signal, the mechanical controller 150 de-energizes power source (HV1) 51 at step S052. The mechanical controller 150 waits for the elapse of a time $\tau_{21}$ at steps S053 and S054, and then de-energizes the power source (HV3) 53 and the motor (DCM) 22, and thus terminates the operation.

The above control operation is basically identical to that achieved by the mechanical controller 100 shown in FIG. 5. Accordingly, the advantages obtained by the mechanical controller 100 are maintained by the mechanical controller 150.

The control circuit construction of the mechanical controllers 100 and 150 is simple, and may be easily manufactured. Also there is no necessity for time-consuming adjustments in the above embodiments. The timings of the timers 101 to 104 and 111 to 113 may be easily changed, and therefore, the mechanical controllers 100 and 150 are applicable to any other electrophotographic printing system having the structure as set forth above.

The power source ($HV_4$) 54 supplying a voltage −HV to the image transfer device 8 may be energized at the time $t_{10}$ and de-energized at the time $t_{20}$ in FIG. **6*a***.

The discharging device 7 in FIG. 1 may be provided between the cleaner 6 and the precharger 2, as shown by the dotted line. The angle $\theta_3$ will thus be changed, and accordingly, the operation time may be changed, but the above mentioned control principle still applies.

Figures 10A, 10B, 10C:
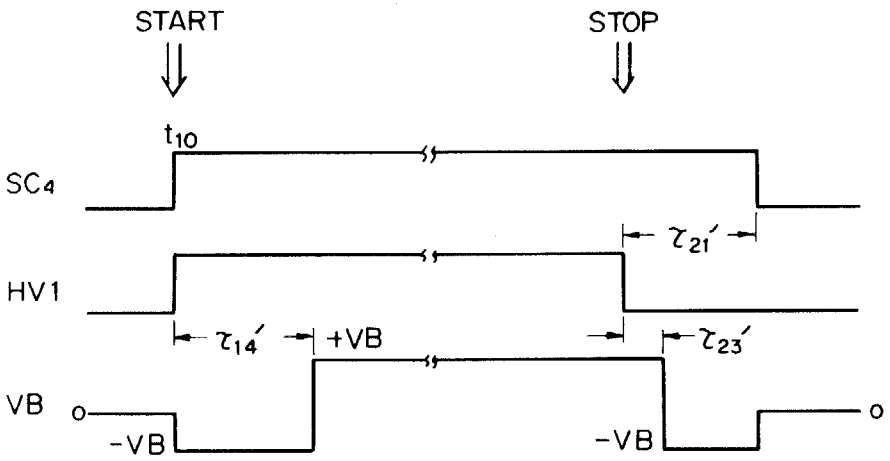
FIGS. 10*a* to 10*c* are timing charts of the control circuits shown in FIGS. 5 and 8.

Referring to FIGS. 10a to 10c, still another embodiment will be described. In a start-up condition, the precharger 7 was energized after the elapse of the time $\tau_{12}$ for a time when a portion of the light sensitive layer on the drum moves from the discharging device 7 to the precharger 2, as shown in FIG. 6b. This charges the light sensitive layer after the light hysterisis is given to the light sensitive layer by the discharging device 7 and improves an initial stability of the charge potential. In FIG. 10b, the precharger 2 is energized at the same time as the energizing of the motor 22. In this case, the time $\tau_{12}$ of the timer 102 in FIG. 5 or the timer 154 in FIG. 8 is set to zero, or the timer 102 may be omitted, resulting in a simplified circuit construction. Conversely, a somewhat surplus toner extraction would occur. However, a predetermined time for the rotatable drum to reach a speed is required, and accordingly, a region of the light sensitive layer on the drum precharged by the precharger 2 is not large. As a result, the surplus toner extraction may be practically carried out.

As seen from the above, a timing applying the bias to the developing roller 31 may be defined from the start time of the rotatable drum 1 and may be changed due to the magnetization on the light sensitive drum or non-magnetization on the same.

Figure 9A:
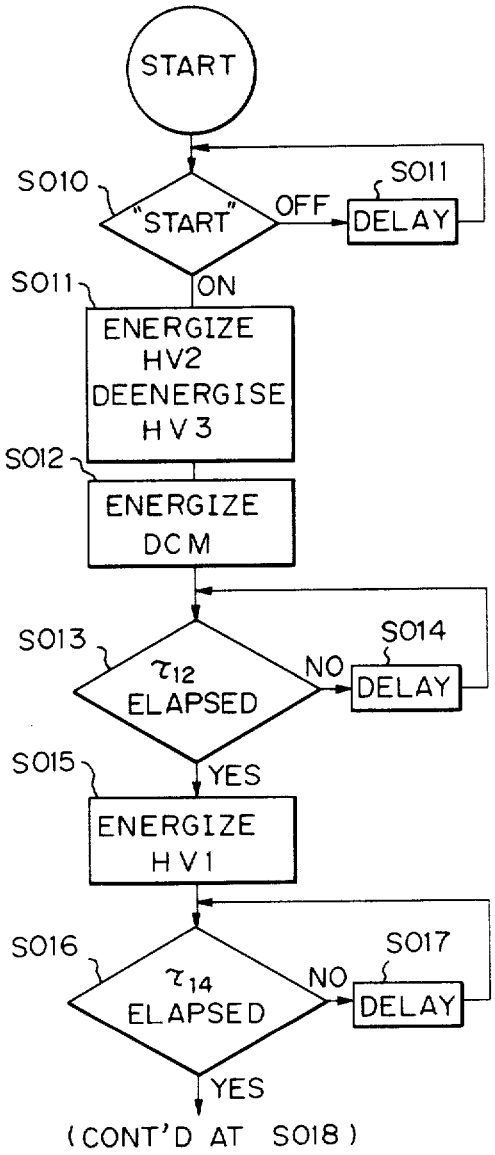
FIG. 9 is a flowchart of the control tasks in the control circuit shown in FIG. 8.
Figure 9B:
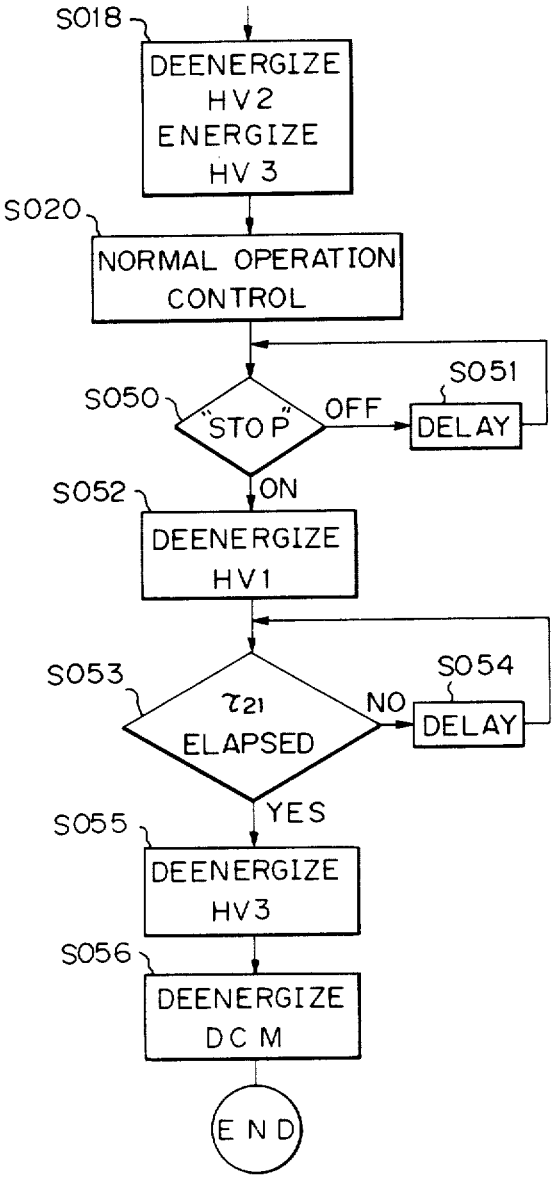

In addition, in the stop condition, another stop sequence as shown in FIGS. 10a to 10c can be applied. The rotatable drum 1 is basically stopped after the elapse of time determined when a portion of the sensitive layer faces the precharger 2 at the stop signal reception and at the time the precharger 2 de-energizes and passes the developing roller 31. However, stopping the rotatable drum cannot be precisely determined due to an inertia thereof, etc. Thus, the stop time of the rotatable drum should increased. The elapsed time $\tau_{21}'$ in FIG. 10a may be set longer than the time $\tau_{21}$ in FIG. 21 and a time $\tau_{23}'$ may be equal to the time $\tau_{23}$ in FIG. 6c. The developing roller 31 is biased with the negative voltage $-VB$ for preventing the surplus toner extraction at the noncharged light sensitive layer on the basis of a principle the same as that of the start-up mode during a time $\tau_{21}'-\tau_{23}'$. The above stop operation may be realized in the circuit in FIG. 5 by adding a timer after the timer 113, as shown by the circuit construction of the timers 103 and 104, for the start-up operation. Similarly, the circuit shown in FIG. 8 may easily affect the above operation. Minor changes in the flow charts shown in FIGS. 9a and 9b are, however, are omitted.

In the above embodiments, the rotatable drum 1 and the light sensitive layer coated thereon are used, however, a photo-receptive sheet covering thereon may be used. The printing principle is maintained in this case.

In the above, a printing medium composed of carriers and toner is used, and each carrier has a larger diameter than that of each toner. The carrier and the toner having approximately the same diameter may be used without a change in the fundamental operation.

Furthermore, another printing medium composed of resin toner comprising a mixed resin and magnetized powder, and a charge control medium mixed with the resin toner may be used. This printing medium is known as mono-component developing medium, and has approximately a 10 to 20 μm diameter. The mono-component developing medium is charged by friction with the sleeve on the developing roller 31 and the blade 34 during delivery to the sleeve of the developing roller 31. The mono-component developing medium is charged to a polarity the same as the polarity of the light sensitive layer. Accordingly, the principle of the reversal image development is the same as in the above description. In this case, the magnets in the developing roller 31 rotate and the sleeve also rotates. Note that the mono-component developing medium does not include carriers. Accordingly, the problem of carrier extraction does not occur.

Many widely different embodiments of the present invention may be constructed without departing from the spirit and scope of the present invention. It should be understood that the present invention is not limited to the specific embodiments described in this specification, except as defined in the appended claims.

What is claimed is:

1. A two component reversal image development type electrophotographic printing system comprising:

rotatable means having light sensitive means mounted thereon;

precharging means including:

a precharger provided adjacent to an outer surface of said rotatable means; and a first power supply, connected to said rotatable means and said precharger, supplying a high voltage to said precharger and charging said light sensitive means to a predetermined voltage;

exposing means, connected to said light sensitive means, for exposing said charged light sensitive means to light beams for forming latent images in said charged light sensitive means;

developing means, connected to said light sensitive means, for developing images at portions of said light sensitive means on which said latent images are formed, said developing means including:

image developing roller means co-rotatable with said rotatable means and containing magnets and a sleeve covered thereon;

a second power supply, connected to said image developing roller means, for supplying a first bias voltage having a predetermined value which is equal to or greater than zero and having a polarity which is an inverted polarity of the high voltage from said first power supply to said image developing roller means for preventing a deposition of a printing medium on said light sensitive means until a portion of the light sensitive means precharged by the precharging means passes said image developing roller means; and a third power supply, connected to said image developing roller means, for supplying a second bias voltage having a predetermined value and having the same polarity as the first power supply, to said image developing roller means for performing an image developing operation in a normal condition;

discharging means, connected to said light sensitive means, for discharging charges on said light sensitive means; and controlling means, connected to said rotatable means and said image developing roller means, for controlling at least a start of said rotatable means and said image developing roller means, and energization and de-energization of said first, second and third power supplies, in a predetermined sequence in accordance with various positions of said precharging means, said image developing roller means, and said discharging means, and a rotational speed of said rotatable means, in at least the start-up condition.

2. A two component reversal image development type electrophotographic printing system according to claim 1, wherein said control means controls said rotatable means, said image developing roller means co-rotatable with said rotatable means, and said first, second, and third power supplies during the start-up condition by starting said rotatable means to rotate and energizing said second power supply, energizing said first power supply after the first time has elapsed, and energizing said third power supply and de-energizing said second power supply after the a second time has elapsed, the second time determined by when said portion of said light sensitive means facing said discharging means at the initial condition reaches said image developing means after said rotatable means starts rotating.

3. A two component reversal image development type electrophotographic printing system according to claim 2, wherein said control means includes timer means for counting said times.

4. A two-component reversal image development type electrophotographic printing system according to claim 3, wherein said rotatable means is a rotatable drum and wherein said light sensitive means is a light sensitive layer coated on said rotatable drum.

5. A two component reversal image development type electrophotograhic printing system according to claim 4, wherein said first time is determined when a portion of said light sensitive means facing said discharging means at an initial condition reaches said precharging means after said precharging means is energized.

6. A two component reversal image development type electrophotographic printing system according to claim 5, wherein said printing medium includes carriers and toner, said toner being electrostatically charged by friction electricity caused by agitating said carriers and said toner and having a same polarity as a charge on said light sensitive layer.

7. A two component reversal image development type electrophotographic printing system according to claim 6, wherein said control means further controls, in a stop condition, said rotatable means, said image developing roller means co-rotatable with said rotatable means and said first and third power supplies by de-energizing said first power supply, stopping said rotation of said rotatable means, and de-energizing said third power supply, after a third time has elapsed, determined when a portion of said light sensitive layer facing said discharging means at the beginning of a stop time reaches said image developing roller means.

8. A two component reversal image development type electrophotographic printing system according to claim 7, wherein said control means includes a timer means for counting said third time.

9. A two component reversal image development type electrophotographic printing system according to claim 4, wherein said first time is zero.

10. A two component reversal image development type electrophotographic printing system according to claim 9, wherein said printing medium includes carriers and toner, said toner being electrostatically charged by friction electricity caused by agitating said carriers and said toner and having a same polarity as a charge on said light sensitive layer.

11. A two component reversal image development type electrophotographic printing system according to claim 10, wherein said control means further controls, in a stop condition, said rotatable means, said image developing roller means co-rotatable with said rotatable means and said first and third power supplies by de-energizing said first power supply, stopping said rotation of said rotatable means and de-energizing said third power supply, after the elapse of a third time determined when a portion of said light sensitive layer facing said discharging means at the beginning of a stop time reaches said image developing roller means.

12. A two component reversal image development type electrophotographic printing system according to claim 11, wherein said control means includes a timer means for counting said third time.

13. A two component reversal image development type electrophotographic printing system according to claim 4, further comprising a printing medium, wherein said printing medium includes resin toner comprising a mixed resin and magnetized powder and a charge control medium mixed with said resin toner, said resin toner being electrostatically charged by said sleeve on said developing roller means.

14. A two component reversal image development type electrophotographic printing system according to claim 13, wherein said first time is determined when a portion of said light sensitive means facing said discharging means at an initial condition reaches said precharging means after said precharging means is energized.

15. A two component reversal image development type electrophotographic printing system according to claim 13, wherein said first time is zero.

16. A two component reversal image development type electrophotographic printing system according to claim 1, wherein said high voltage of said first power supply is approximately 5 KV to 6 KV, and charges of approximately 500 V to 600 V are supplied to said light sensitive means, which are reduced to approximately 0 V to 100 V by said exposure to said light beams, said first bias voltage of said second power supply being −50 V to −100 V and said second bias voltage of said third power supply being approximately 300 V.

17. A two component reversal image development type electrophotographic printing system according to claim 16, further comprising:

paper;

a cleaner in contact with said light sensitive means;

an image transfer device, connected to said light sensitive means, for transferring toner of said printing medium deposited on said light sensitive means to said paper;

a paper separator, located between said paper and said light sensitive means, for separating said paper attached to said light sensitive means; and an image fixing device, connected to said paper, for fixing said toner on said paper.

* * * * *

UNITED STATES PATENT AND TRADEMARK OFFICE

CERTIFICATE OF CORRECTION

PATENT NO. : 4,714,942

DATED : December 22, 1987

INVENTOR(S) : Akio NAKANISHI

It is certified that error appears in the above-identified patent and that said Letters Patent is hereby corrected as shown below:

Column 2, line 11, delete "unit" (second occurrence);
line 65, change "lapsed" to --lapse--.

Column 5, line 21, change "$\eta_2$" to --$\Theta_2$--.

Signed and Sealed this

Seventh Day of June, 1988

*Attest:*

*Attesting Officer*

DONALD J. QUIGG

*Commissioner of Patents and Trademarks*